US005921291A

United States Patent [19]

Hord et al.

[11] Patent Number: 5,921,291

[45] Date of Patent: Jul. 13, 1999

[54] PROCESS AND APPARATUS FOR FILLING ACETYLENE CYLINDERS CONTAINING A POROUS PACKING MATERIALS

[75] Inventors: W. D. Hord; Ted Royer, both of Bellville, Tex.

[73] Assignee: Western International Gas and Cylinders Inc., Bellville, Tex.

[21] Appl. No.: 08/831,637

[22] Filed: Apr. 9, 1997

[51] Int. Cl.[6] ..... B65B 31/00

[52] U.S. Cl. ..... 141/82; 141/4; 141/11; 141/18

[58] Field of Search ..... 141/2–4, 11, 18, 141/21, 82, 248

[56] References Cited

U.S. PATENT DOCUMENTS

| | | | |
|---|---|---|---|
| 4,129,450 | 12/1978 | Flanigen et al. . | |
| 4,153,083 | 5/1979 | Imler et al. | 141/4 |
| 4,527,600 | 7/1985 | Fisher et al. | 141/4 |
| 4,582,100 | 4/1986 | Poulsen | 141/4 |
| 4,585,039 | 4/1986 | Hamilton | 141/4 |
| 4,655,798 | 4/1987 | Ruch et al. | 55/64 |
| 4,705,082 | 11/1987 | Fanshaw et al. | 141/4 |
| 5,292,707 | 3/1994 | Aparicio et al. . | |
| 5,351,726 | 10/1994 | Diggins | 141/4 |
| 5,385,176 | 1/1995 | Price | 141/4 |
| 5,409,046 | 4/1995 | Swenson et al. | 141/11 |
| 5,461,023 | 10/1995 | Chang et al. . | |
| 5,495,875 | 3/1996 | Benning et al. | 141/3 |
| 5,538,051 | 7/1996 | Brown et al. | 141/18 |
| 5,547,533 | 8/1996 | Berglund . | |
| 5,632,788 | 5/1997 | Rabren | 141/4 |

*Primary Examiner*—J. Casimer Jacyna
*Attorney, Agent, or Firm*—Patterson & Associates

[57] ABSTRACT

An method and apparatus for filling packed cylinders with acetylene. The apparatus includes a variable speed compressor which delivers the gas to a manifold. The compressor is operated continuously to maintain a continuous flow of acetylene to the manifold and maintain either a substantially constant manifold pressure or a gradually increasing manifold pressure. The method and apparatus of the invention fills a large number of packed cylinders in less than half the time required by operation of conventional two-speed compressors. Furthermore, the method and apparatus of the invention simplifies the production and bottling of acetylene and enables complete automation of the bottling process after the packed cylinders are connected to the manifold.

18 Claims, 2 Drawing Sheets

PROCESS AND APPARATUS FOR FILLING ACETYLENE CYLINDERS CONTAINING A POROUS PACKING MATERIALS

BACKGROUND OF THE INVENTION

This invention relates to filling of gas cylinders having a porous packing material with acetylene. More specifically, the invention relates to a process and apparatus for reducing the time required to fill the cylinders with acetylene.

Production of acetylene by hydration of calcium carbide and compression of the acetylene to fill cylinders containing acetone and a porous packing material is still practiced using methods developed prior to 1940. Improvements to cylinder packing materials and safety procedures have reduced the hazards associated with acetylene production, packaging, and transportation. The acetylene and acetone are safely retained by the packing material allowing for high volume storage of the acetylene at reduced total pressure. However, the production and filling processes are manually controlled over a period of at least about 20 hours from the start of acetylene production to complete filling of a reasonable number of cylinders. The long cycle time includes many hours of idle time waiting for the acetone to dissolve the acetylene.

As shown in FIG. 1 (Prior Art), filling of packed cylinders 10 with acetylene is typically achieved with a single speed or a two-speed compressor 12 which receives acetylene from a calcium carbide hydration unit 14. The acetylene is typically produced at a pressure less than 15 psig and is then passed through a heat exchanging cooler 16 to reduce the temperature of the acetylene gas to at least about 10° C. The acetylene is then passed through a drier 18 to remove water and a purifier 20 to remove other contaminants. The acetylene is washed in a scrubber 22 prior to entering the compressor 12. The pressure of the acetylene is typically from 5 to 10 psig prior to entering the compressor 12. The acetylene must be compressed to a pressure of at least 250 psig to completely fill a packed cylinder 10. A high pressure drier 24 removes oil and condensed water from the pressurized acetylene. The compressed acetylene is held in a manifold 26 which has connections for a plurality of packed cylinders 10. The pressure of acetylene in the manifold 26 is controlled by shutting off the compressor 12 or switching to low speed if available. A cooling water supply 28 provides cooling water to the heat exchanging cooler 16 and excess cooling water 30 is often sprayed on the cylinders 10 for cooling of gas lines and the cylinders.

The number of cylinders 10 which can be filled at one time primarily depends on the volume capacity of the compressor 12 which account for most of the capital cost. Filling of the cylinders 10 typically begins with the compressor 12 set at 100% power. The acetylene pressure in the manifold 26 steadily rises to a pressure of about 350 psig while the acetylene slowly fills the cylinders. Diffusion of the acetylene into the cylinders is slow, but is enhanced by cooling the cylinders. Absent the packing material and the acetone, the cylinders would rapidly fill at 250 psig but would contain compressed acetylene at a much lower stability than dissolved acetylene at 250 psig. The manifold pressure is typically allowed to drop 100 psig before the compressor 12 is turned on again. Cycling of the compressor 12 continues until a lack of a significant pressure drop indicates that the cylinders are full. As the cycles are repeated, the compressor 12 is operated for progressively shorter time periods. The compressors 12 are very inefficient when operated for short intervals at 100% power. Thus two-speed compressors are typically switched to 50% speed when the compressor will not run long at 100% speed. Combining the compressing time and the idle time for all cycles, the time required to fill the cylinders to about 95% capacity is typically at least 20 hours for a reasonable amount of cylinders.

Repeated cycling of the one speed or two speed compressors 12 results in many hours of reduced demand or no demand for acetylene which limits production capacity. However, the high capital costs for the compressors 12 essentially results in acceptance of the production capacity which can be achieved with the available compressors. An increase in acetylene bottling capacity typically requires the purchase of additional compressors. Repeated cycling of the compressors also leads to high electric bills because of the high peak load required to start the compressor.

It is an object of the present invention to improve acetylene production by reducing the time needed to fill a reasonable number of packed cylinders. It is a further object of the present invention to reduce the frequent on/off cycling of acetylene compressors so that the process of filling packed cylinders with acetylene can be more easily controlled and frequent start-up of the compressors can be eliminated.

SUMMARY OF THE INVENTION

The present invention provides a method and apparatus for filling packed cylinders with acetylene. The apparatus includes a variable speed compressor which provides compressed acetylene to a manifold which has a plurality of connections for the packed cylinders. The variable speed compressor is preferably operated to maintain a substantially constant manifold pressure while filling the cylinders. The variable speed compressor is alternatively operated by gradually increase the manifold pressure while filling the cylinders so that the maximum cylinder pressure is not achieved until the cylinders are full. Combination of the variable speed compressor with increased cylinder cooling allows continuous filling of a large number of packed cylinders in less than half the time required by intermittent operation of one-speed or two-speed compressors. Furthermore, the method and apparatus of the invention enables complete automation of the acetylene production and bottling process after the cylinders are connected to the manifold.

DESCRIPTION OF THE DRAWINGS

So that the above recited features, advantages and objects of the present invention can be understood in detail, a more particular description of the invention, briefly summarized above, may be had by reference to the embodiments thereof which are illustrated in the appended drawings.

It is to be noted, however, that the appended drawings illustrate only typical embodiments of this invention and are therefore not to be considered limiting of its scope, for the invention may admit to other equally effective embodiments.

DETAILED DESCRIPTION OF THE INVENTION

The present invention provides an apparatus for filling available packed cylinders with acetylene, the apparatus comprising an acetylene source, a manifold having an outlet for connecting and filling a plurality of packed cylinders, and a variable speed compressor connecting the acetylene source to the manifold. The acetylene source can be a calcium carbide hydration unit or another acetylene source such as by-product acetylene from ethylene production. The apparatus further provides cooling of the packed cylinders and process control equipment which can include a system controller which is programmed to control filling of the cylinders.

Figure 1:
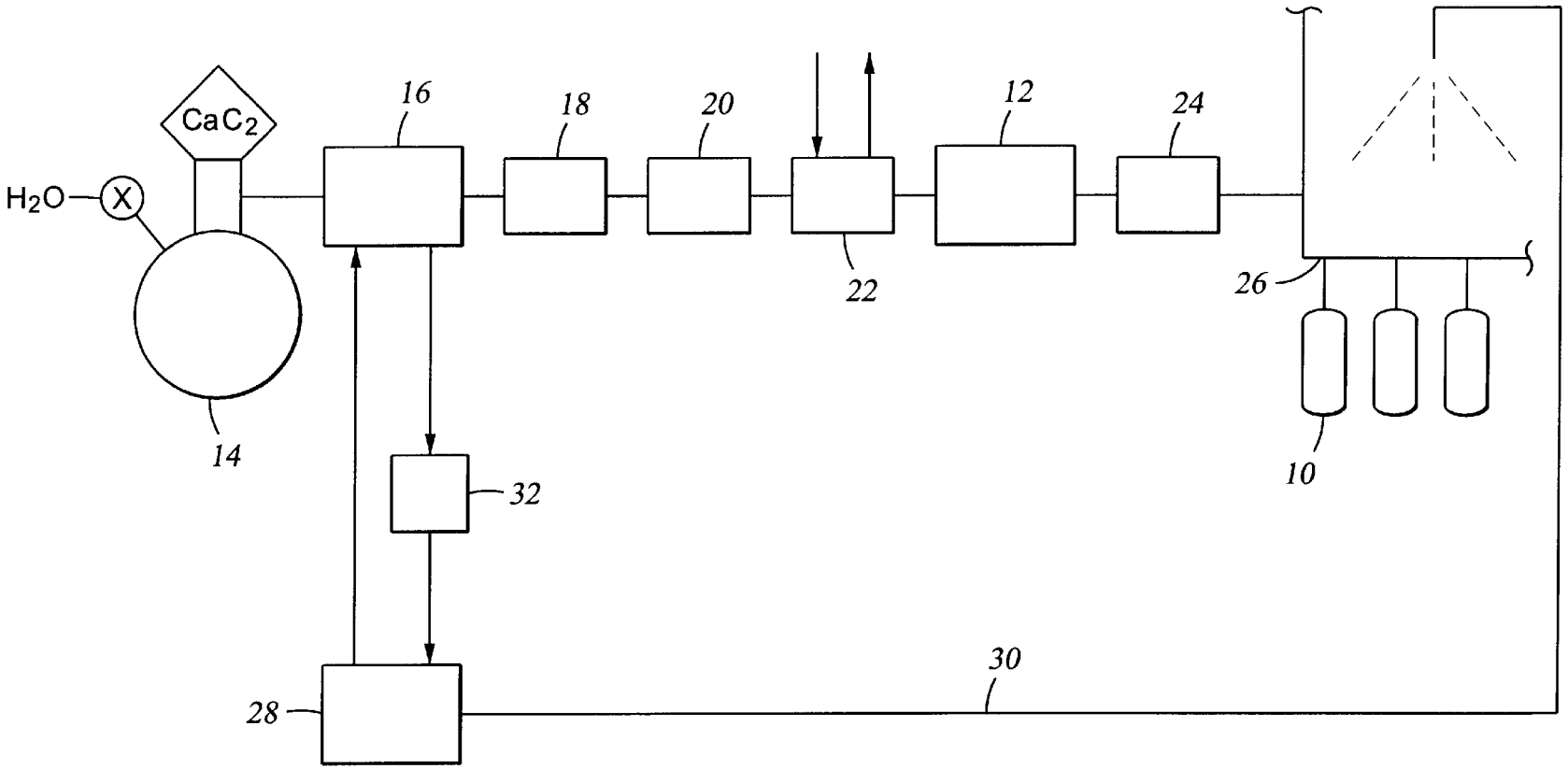
Fig. 1 (PRIOR ART)
FIG. 1 (prior art) is a schematic diagram of existing commercial processes for producing acetylene and filling packed cylinders with acetylene using a one speed or two speed compressor.
Figure 2:
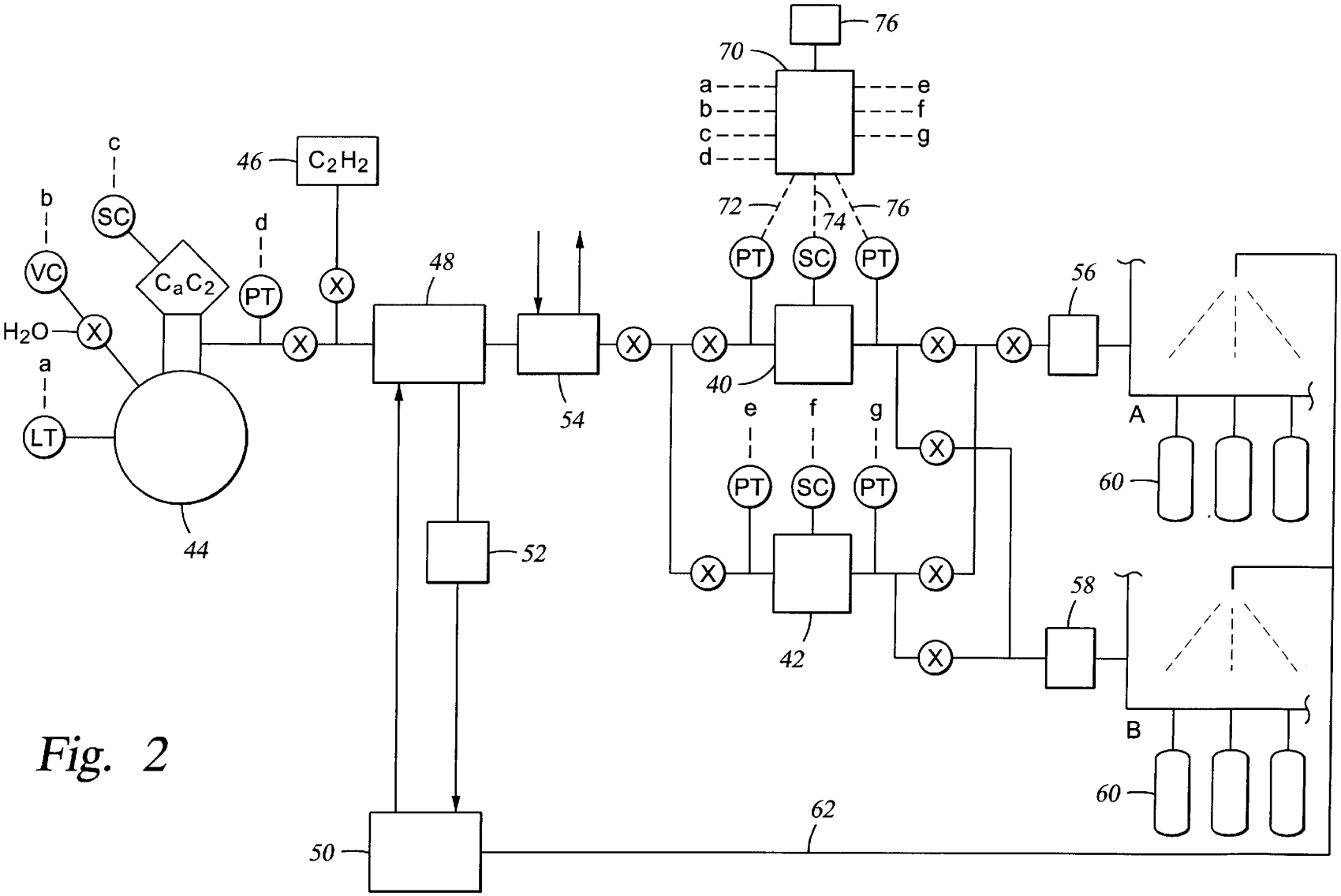
FIG. 2 is a schematic diagram of an automated acetylene plant which includes several variable speed compressors.

FIG. 2 shows an automated acetylene plant which includes first and second variable speed compressors 40, 42 to supply compressed acetylene to a plurality of manifolds including first and second manifolds A, B. The acetylene plant primarily obtains acetylene from a calcium carbide hydration unit 44. However, the plant is also equipped to receive acetylene from ethylene plants using a large array of packed cylinders 46 which is transported to an ethylene plant and filled with acetylene by-product which is typically flared instead of bottled. A preferred acetylene plant has two or more acetylene sources and about two variable speed compressors for each acetylene source.

The acetylene from the acetylene source is cooled to a temperature between 10° C. and 20° C. in a heat exchanging cooler 48. The cooler 48 receives the cooling water from a reservoir 50 which collects the water from a chiller 52 such as a Trane Chiller System. On cold days, the chiller can be by-passed and the water sent to a cooling tower before returning to the reservoir. The cooled acetylene does not need additional drying or purifying before scrubbing in a conventional scrubber 54.

The acetylene is compressed by one or both of the variable speed compressors 40, 42 to provide compressed acetylene to one or both of the manifolds A, B. The acetylene provided to each manifold is first dried in high pressure driers 56, 58. The preferred driers 56, 58 are regenerative desiccant driers which contain a desiccant which does not react with acetylene and which regenerates at a temperature below 130° C. Such driers are commercially available although modification is required for safe handling of acetylene. Specifically, valves approved for acetylene must be installed and the valves must be operated at slow speeds. Regeneration of the desiccant with a long cycle of about four hours at about 120° C. has worked well in comparison to short cycle regeneration at lower temperatures.

Connecting all available compressors 40, 42 in parallel to supply all available manifolds A, B provides processing advantages which are described below. Each of the compressors 40, 42 compresses a sufficient amount of acetylene to supply more than 10 manifolds wherein each manifold has connections for more than 80 packed cylinders 60. Additional manifolds are included in the plant to allow time for connecting and disconnecting cylinders.

The chilled water reservoir 50 provides chilled water 62 for cooling of the packed cylinders 60 while filling to promote faster filling of the cylinders 60. When filled, the cylinders must not exceed a maximum allowable gas pressure at a temperature defined by regulations. Thus, cooling of the cylinders 60 does not increase the capacity of the cylinders. Inadequate cooling of the cylinders allows the cylinder temperatures to rise and slow down the filling process.

The variable speed compressors 40, 42 and the calcium carbide hydration unit 44 are preferably operated by a system controller 70 over control lines 70, 72, 74, *a–g*. The system controller includes analog assemblies, such as valve controllers VC, pressure transmitters PT, speed controllers SC, and level transmitters LT, that are monitored and controlled by the system controller 70 which executes system control software stored in a memory 76, which in the preferred embodiment includes EPROM, RAM, or a hard disk drive.

The system controller 70 controls all of the activities of the acetylene filling process, and a preferred embodiment of the controller 70 includes a hardened 32 bit, multi-tasking processor, battery backed RAM, and serial controlled intelligent Input/Output. The interface between a user and the system controller 70 is via a monitor workstation which can be directly or remotely connected to the system controller. The system controller 70 operates under the control of a computer program stored on the hard disk drive of the monitor workstation. The computer program dictates the sequence of process steps and the parameters of a particular process step.

The process steps discussed below can be implemented using a computer program product that runs on, for example, the system controller 70. The computer program code can be written in any conventional computer readable programming language such as for example 68000 assembly language, C, C++, Pascal, or other system specific control languages. Suitable program code is entered into a single file, or multiple files, using a conventional text editor or other system specific program coding methods such as flowchart or loaded logic code. The program code is stored or embodied in a computer usable medium, such as a memory system of the computer. If the entered code is in a high level language, the code is compiled, and the resultant compiler code is then linked with an object code of precompiled library routines. To execute the linked compiled object code, the system user invokes the object code, causing the computer system to load the code in memory, from which the CPU reads and executes the code to perform the tasks identified in the program.

The present invention provides a process for filling packed cylinders connected to a manifold, the process comprising the steps of compressing acetylene in a variable speed compressor, and delivering the compressed gas through the manifold to the packed cylinders. The process preferably includes the step of cooling the cylinders while filling. Further, if adequate cylinder cooling is available, the manifold pressure preferably is ramped up quickly and then maintained at a substantially constant pressure until the cylinders are full. Alternatively, the manifold pressure can be increased gradually to the final manifold pressure until the cylinders are filled. The process can be controlled manually or by computer program code to substantially reduce the time required to fill the cylinders and to reduce or eliminate interim start up of the variable speed compressors.

Existing acetylene plants having single speed or two-speed compressors are incapable of operation at a gradually increasing manifold pressure or a substantially constant manifold pressure for sustained periods. The acetylene plant of the present invention employs one or more variable speed compressors which can be operated to quickly raise the manifold pressure and then one of the compressors can maintain the manifold pressure at a substantially constant pressure until the cylinders are fill. Alternatively, the available compressors gradually increase the manifold pressure, preferably by continuously maintaining a constant manifold pressure for a brief time such as one hour and then raising the manifold pressure for each succeeding hour. The gradual increase in manifold pressure slows down the rate of filling of the cylinders to reduce heating of the cylinder and allow continuous operation of the compressors. The maximum manifold pressure needed to fill the cylinders may be achieved just prior to complete filling of the cylinders.

The method and apparatus of the invention fills a large number of packed cylinders in less than half the time required by operation of conventional one-speed or two-speed compressors. Cylinder filling has been reduced from 20 hours to about 5 hours by quickly raising the manifold pressure to 250 psig and substantially maintaining that pressure until the cylinders are full. Cylinder filling has been reduced from 20 hours to less than 10 hours by beginning the manifold pressure at 75 psig and raising the manifold pressure each hour by 30 psig. A similar result would occur by gradually raising the manifold pressure at smaller increments such as 10 psig for smaller intervals such as 20 minutes.

The method and apparatus of the invention simplifies the production and bottling of acetylene and enables complete automation of the process after the cylinders are connected to the manifold. The speed of the compressors 40, 42 is determined by continuously comparing the measured manifold pressures to the programmed manifold pressures and increasing or decreasing the compressors speeds accordingly. The acetylene source is controlled to provide a nearly constant pressure at the inlet to the compressors, preferably about 8 psig. For the calcium carbide hydration unit 44 or the array of packed cylinders 46, acetylene is also provided at a near constant pressure, preferably 12 to 15 psig. The hydration unit 44 can also be automated to provide acetylene at a constant pressure of 12 to 15 psig by monitoring and controlling the feed rate of calcium carbide and the water level in the unit. Preferably, agitation of the hydration unit 44 and water spraying on floating calcium carbide are also monitored and controlled since increased water spray and increased agitation are needed to process dusty calcium carbide at a constant pressure in comparison to dust free chunks of calcium carbide. Automation of acetylene plants having more than one compressor provides the additional benefit of avoiding start-up of more than one compressor at a time which can substantially increase electricity bills when based on peak demand.

While the foregoing is directed to the preferred embodiment of the present invention, other and further embodiments of the invention may be devised without departing from the basic scope thereof, and the scope thereof is determined by the claims which follow.

What is claimed is:

1. An apparatus for filling packed cylinders, comprising:

an acetylene source;

a manifold having a plurality of ports for connecting and filling packed cylinders;

a variable speed compressor connecting the acetylene source to the manifold; and a system controller programmed to continuously operate the variable speed compressor and provide a gradually increasing manifold pressure while filling the packed cylinders.

2. The apparatus of claim 1, wherein the acetylene source is a calcium carbide hydration unit.

3. The apparatus of claim 1, wherein the acetylene source is an ethylene production unit.

4. The apparatus of claim 3, wherein the acetylene source is an array of packed cylinders which is filled by the ethylene production unit.

5. The apparatus of claim 1, further comprising a cooling means for cooling packed cylinders connected to the manifold.

6. The apparatus of claim 5, wherein the system controller is programmed to continuously increase the manifold pressure until the cylinders are full.

7. A process for filling packed cylinders connected to a manifold, comprising the steps of:

compressing acetylene in a variable speed compressor; and delivering the compressed acetylene through the manifold to the packed cylinders;

wherein the variable speed compressor is continuously operated to provide a gradually increasing manifold pressure while filling the packed cylinders.

8. The process of claim 7, wherein the compressed acetylene is continuously delivered to the manifold from initial filling of the packed cylinders until the cylinders are full.

9. The process of claim 8, wherein the compressed acetylene is delivered to the packed cylinders at a continuously increasing manifold pressure.

10. The process of claim 7, further comprising the step of cooling the packed cylinders before the cylinder are full.

11. The process of claim 10, wherein the manifold initially receives the compressed gas from two variable speed compressors.

12. The process of claim 10, wherein the manifold operates at a continuously increasing pressure.

13. The process of claim 7, further comprising the steps of controlling each process step with a system controller programmed to maintain a continuous flow of acetylene to the manifold.

14. The process of claim 7, wherein a plurality of empty packed cylinders are filled with acetylene in less than 5 hours.

15. An acetylene plant, comprising:

an acetylene source;

a manifold having connections for a plurality of packed cylinders;

a compressor connecting the acetylene source to the manifold;

a system controller for controlling the acetylene source and the compressor, and a memory coupled to the controller, the memory comprising a readable program code for selecting a process comprising the steps of compressing acetylene from the acetylene source in the compressor, and delivering the compressed acetylene through the manifold to the packed cylinders at a gradually increasing manifold pressure until the cylinders are filled.

16. The acetylene plant of claim 15, wherein the acetylene source combines water and calcium carbide to produce acetylene.

17. The acetylene plant of claim 16, further comprising a cooling means for cooling the cylinders and program code for cooling the cylinders during filling of the cylinders.

18. The acetylene plant of claim 17, wherein the compressor is a variable speed compressor and the program code further comprises program code for maintaining a continuous flow of acetylene to the manifold to provide a continuously increasing manifold pressure.

* * * * *